US006763547B1

(12) United States Patent
Brewer et al.

(10) Patent No.: US 6,763,547 B1
(45) Date of Patent: Jul. 20, 2004

(54) DEVICE FOR CLEANING A HOSE

(76) Inventors: Robert D. Brewer, 5030 E. Virginia Ave., Phoenix, AZ (US) 85008-1627; James K. Watson, 2612 N. 49th Pl., Phoenix, AZ (US) 85008

( * ) Notice: Subject to any disclaimer, the term of this patent is extended or adjusted under 35 U.S.C. 154(b) by 191 days.

(21) Appl. No.: 10/053,093

(22) Filed: Jan. 23, 2002

(51) Int. Cl.[7] ..... A47L 5/38

(52) U.S. Cl. ..... 15/302; 15/303; 15/308; 15/309.1

(58) Field of Search ..... 15/302, 303, 306.1, 15/308, 309.1

(56) References Cited

U.S. PATENT DOCUMENTS

| | | | | | |
|---|---|---|---|---|---|
| 3,530,526 | A | * | 9/1970 | Schmidt | 15/302 |
| 4,503,577 | A | | 3/1985 | Fowler | 15/88 |
| 4,591,390 | A | * | 5/1986 | Scott et al. | 15/302 |
| 5,002,101 | A | | 3/1991 | McLeod | 141/83 |
| 5,056,185 | A | * | 10/1991 | Schotter | 15/302 |
| 5,077,861 | A | | 1/1992 | Bokat | 15/256.5 |
| 5,109,565 | A | * | 5/1992 | Akin et al. | 15/309.1 |
| 5,322,571 | A | | 6/1994 | Plummer et al. | 134/22.12 |
| 5,356,480 | A | | 10/1994 | Melgeorge | 134/15 |
| 5,566,415 | A | | 10/1996 | Wallace | 15/88.1 |
| 5,881,419 | A | | 3/1999 | Millard | 15/104.04 |
| 6,003,194 | A | * | 12/1999 | Eckroth | 15/302 |
| 6,487,750 | B1 | * | 12/2002 | Brown | 15/302 |

* cited by examiner

*Primary Examiner*—Theresa T. Snider
(74) *Attorney, Agent, or Firm*—Donald R. Schoonover

(57) ABSTRACT

A device can clean hoses of varying dimensions and uses vacuum, wiping and jet spray to clean a hose. The device can be used to clean carpet cleaning hoses and can be transported on a vehicle.

7 Claims, 8 Drawing Sheets

DEVICE FOR CLEANING A HOSE

BACKGROUND OF THE INVENTION

1. Field of the Invention

The present invention relates to the general art of cleaning, and to the particular field of cleaning the outside of a conduit.

2. Discussion of the Related Art

There are many industries that require the use of a large hose to accomplish an objective. Such industries include firefighting, nuclear power plant cleaning, shipbuilding and maintenance, and the like. Such industries require large volume hoses, that is, hoses that are generally large in outer dimension and long, and may be heavy in construction.

Such high-volume hoses may be very difficult and cumbersome to handle. The difficulty in handling can be accounted for during use of the hose; however, during maintenance of the hose, such difficulty can become onerous. This is especially true during cleaning of the hose. This difficulty is exacerbated if solvents are used during the cleaning process. In addition to the difficulty in handling the hose and in handling solvents or other fluids used to clean such high volume hoses, any debris cleaned from the hose must be contained and properly disposed of. All of these difficulties make the care and maintenance of high-volume hoses difficult.

Accordingly, the art contains several examples of devices and systems intended for use in the care and maintenance of high-volume hoses. However, most of these devices are expensive and do not adequately account for the debris associated with the cleaning operation. Still further, many of these devices are not amenable to hoses having a wide variety of outer dimensional sizes. While somewhat successful in handling high-volume hoses for large industries, many of the known hose cleaning devices are not amenable for use by a small business because of the above-described shortcomings.

Many businesses are not equipped to economically and conveniently maintain large hoses using the presently-available equipment. Many such businesses require the use of large hoses, but such hoses may not be as large as the hoses used in the firefighting industry for example.

One example of such a business is the carpet cleaning business. In the carpet cleaning business, a hose is brought from a truck into a house or other such building to clean a carpet by forcing fluid onto the carpet and removing debris from the carpet through the hose. This hose must be moved over carpet, and beside furniture and other elements that can be damaged or soiled by contact with the hose. If the hose is dirty, the hose itself can be a source of dirt which is counterproductive. That is, if the hose is dirty, it can actually soil the very carpet it is meant to clean. Thus, a hose used in a carpet cleaning operation should be kept as clean as possible. Debris, oil, grease and the like should be removed from the hose as often as possible.

However, most carpet cleaning businesses are not equipped to handle hose cleaning devices such as are known in the prior art and are used for large industries with large equipment and a large source of manpower.

Therefore, there is a need for a hose cleaning device that can adequately clean large hoses yet can be economically and conveniently used by a small business concern.

Still further, many of the known hose cleaning devices are not adaptable for use with hoses having a variety of outer dimensional sizes. For example, if a device is intended to clean firefighting hoses, that device is not easily adapted to clean hoses having outer dimensions much smaller than the outer dimension of fire fighting hoses.

Therefore, there is a need for a hose cleaning device that is amenable to use with a wide variety of hose outer dimensions.

Furthermore, many of the presently-known hose cleaning devices do not adequately remove debris from the hose and then remove that debris from the area of the hose being cleaned. If debris is not removed from the vicinity of the hose cleaning operation, that debris can re-settle back on a cleaned hose thereby vitiating the cleaning process.

Therefore, there is a need for a hose cleaning device that can remove debris from the vicinity of the hose being cleaned.

PRINCIPAL OBJECTS OF THE INVENTION

It is a main object of the present invention to provide a hose cleaning device that can be economically and conveniently used by a small business.

It is another object of the present invention to provide a hose cleaning device that is amenable to use with a wide variety of hose outer dimensions.

It is another object of the present invention to provide a hose cleaning device that can remove debris from the vicinity of the hose being cleaned.

It is another object of the present invention to provide a hose cleaning device that is amendable for use with the carpet cleaning industry.

SUMMARY OF THE INVENTION

These, and other, objects are achieved by a unit for cleaning a hose which comprises a hose reel that can conveniently be stored on a truck, such as that commonly used in the carpet cleaning industry; and a hose cleaning assembly mounted on the hose reel. The hose cleaning assembly includes a vacuum hose mounted on the hose reel to be movable between a first position and a second position, a hollow housing mounted on the vacuum hose and fluidically connected to the vacuum hose, a hose cleaning jet spray unit in the housing, and a hose supporting unit in the housing which includes a spring shock absorber and is movable between a first position and a second position spaced from the first position inwardly of the hollow housing. A source of hose cleaning fluid is fluidically connected to the hose cleaning jet spray unit, and waste water can be moved into and through the vacuum elements of the unit. A hose cleaning brush unit is located in the hollow housing, and a vacuum source is fluidically connected to the vacuum hose.

The unit adapts to any size hose because of the spring mounted hose supporting unit and the hose is washed with a jet spray and a vacuum is applied to be sure that any debris is moved away from the hose. The unit is thus amenable to a large variety of hose sizes and will economically and efficiently clean such hoses.

BRIEF DESCRIPTION OF THE DRAWINGS

FIG. 7 shows a hose being cleaned in one form of the hose cleaning housing unit of the present invention.

FIG. 9 is a cross-sectional view taken along line 9—9 of FIG. 8.

DETAILED DESCRIPTION OF THE INVENTION

Other objects, features and advantages of the invention will become apparent from a consideration of the following detailed description and the accompanying drawings.

The hose cleaning unit embodying the teaching of the present invention not only accommodates hoses having a range of outer dimensions, but does so in a manner that is economical and convenient for use by a small business and will remove debris from the vicinity of the hose being cleaned.

Figure 1:
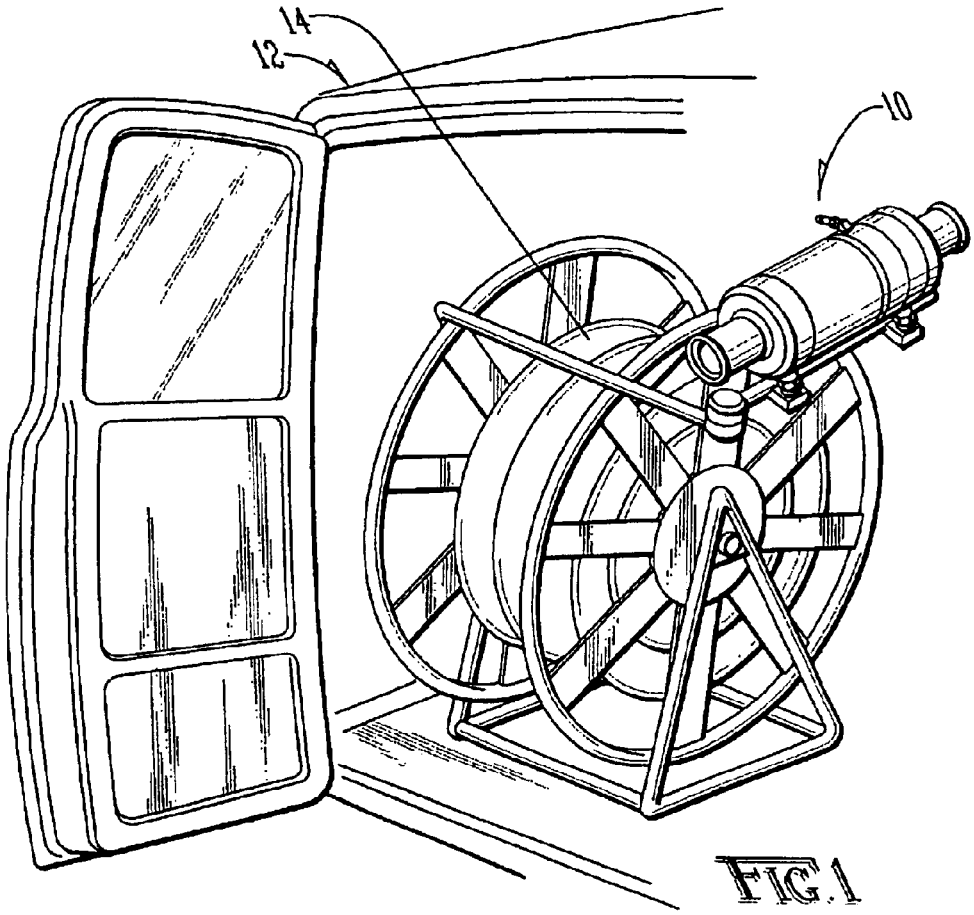
FIG. 1 shows the device and a hose stored in a vehicle, such as would be used by a carpet cleaning company, in a stored configuration.
Figure 2:
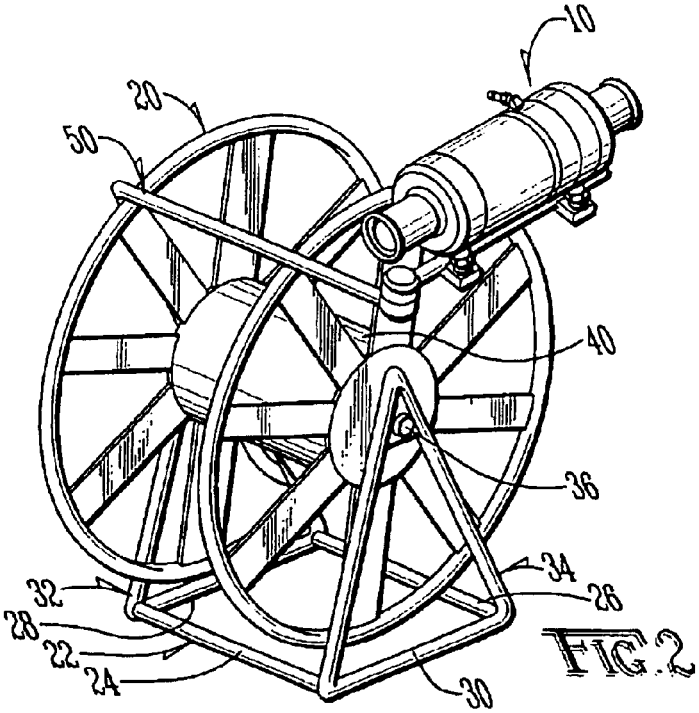
FIG. 2 is a schematic showing the hose cleaning device of the present invention in a stored configuration.
Figure 3:
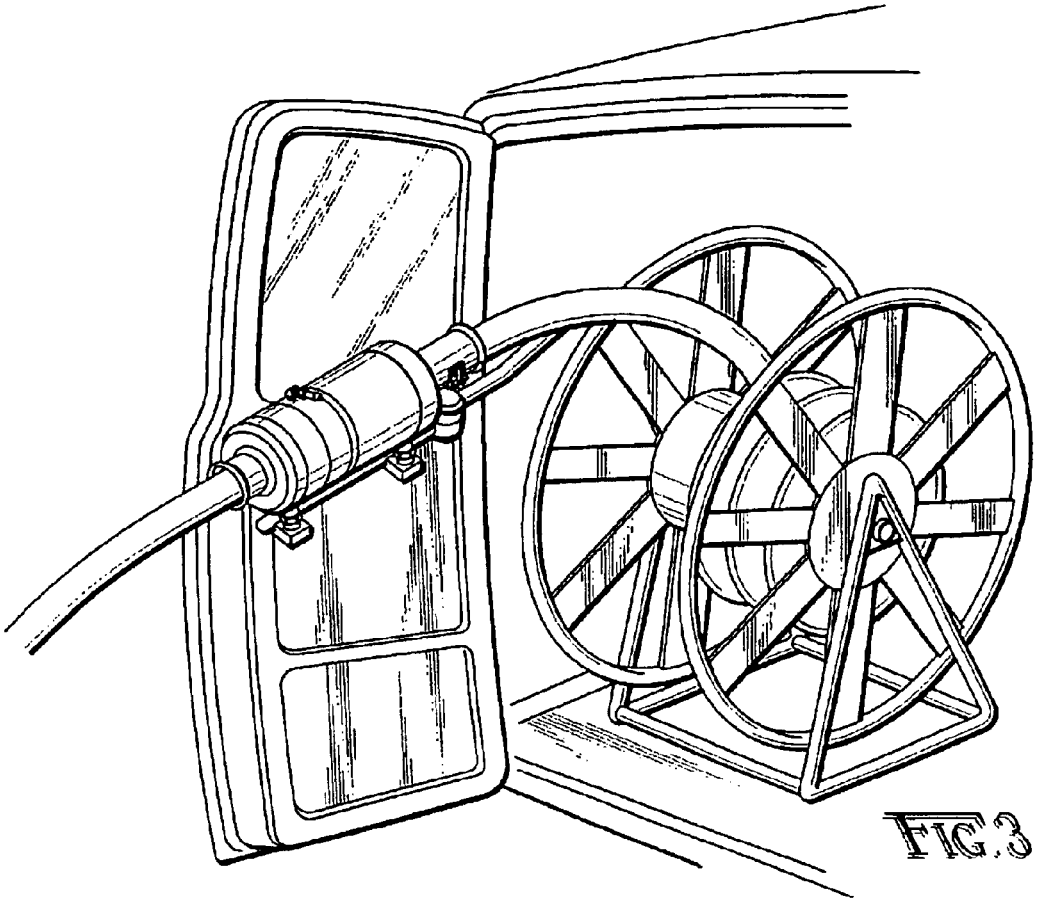
FIG. 3 shows the device and a hose stored in a vehicle, such as would be used by a carpet cleaning company, in a deployed configuration.
Figure 4:
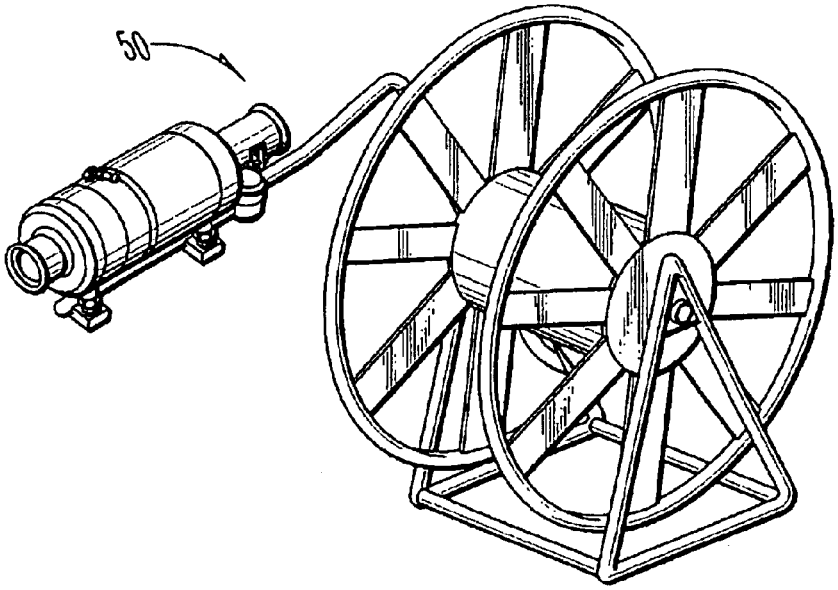
FIG. 4 is a schematic showing the hose cleaning device of the present invention in a deployed configuration.

Referring to FIG. 1, it can be seen that the present invention is embodied in a hose cleaning device 10 that can be stored in a vehicle or truck 12, such as would be used in a carpet cleaning business. More specifically, hose cleaning device 10 can be in a stored configuration as shown in FIGS. 1 and 2 or in a deployed configuration as shown in FIGS. 3 and 4. Hose 14 is moved through a hose cleaning portion of the device as the hose is deployed and/or stored so the hose can conveniently be cleaned before and/or after use. This encourages a user to keep the hose as clean as possible.

As can be seen in FIGS. 2 and 4, device 10 includes a reel unit 20 which is sized to be accommodated on a vehicle or truck such as vehicle 12, and which includes a base 22 which is rectangular and which has a fore end 24, a rear end, and first and second sides 28 and 30. First and second upright standards 32 and 34 are fixed to first and second sides 28 and 30 respectively of base 22 and extend upward from a plane containing base 22. Each of the uprights is triangular with a base portion formed by the side of base 22 associated therewith, and has an apex 36 spaced apart from the plane containing base 22 of reel unit 20. The apexes of upright standards 32 and 34 are spaced apart from each other. A hose storage reel 40 is mounted on the apexes of the upright standards to rotate in a plane spaced from the plane containing base 22 of reel unit 20. The reel unit 20 is stably supported in the rear of the vehicle 12 during transport thereof yet is sturdy enough to securely hold hose 14 in place in the vehicle 12.

Figure 5:
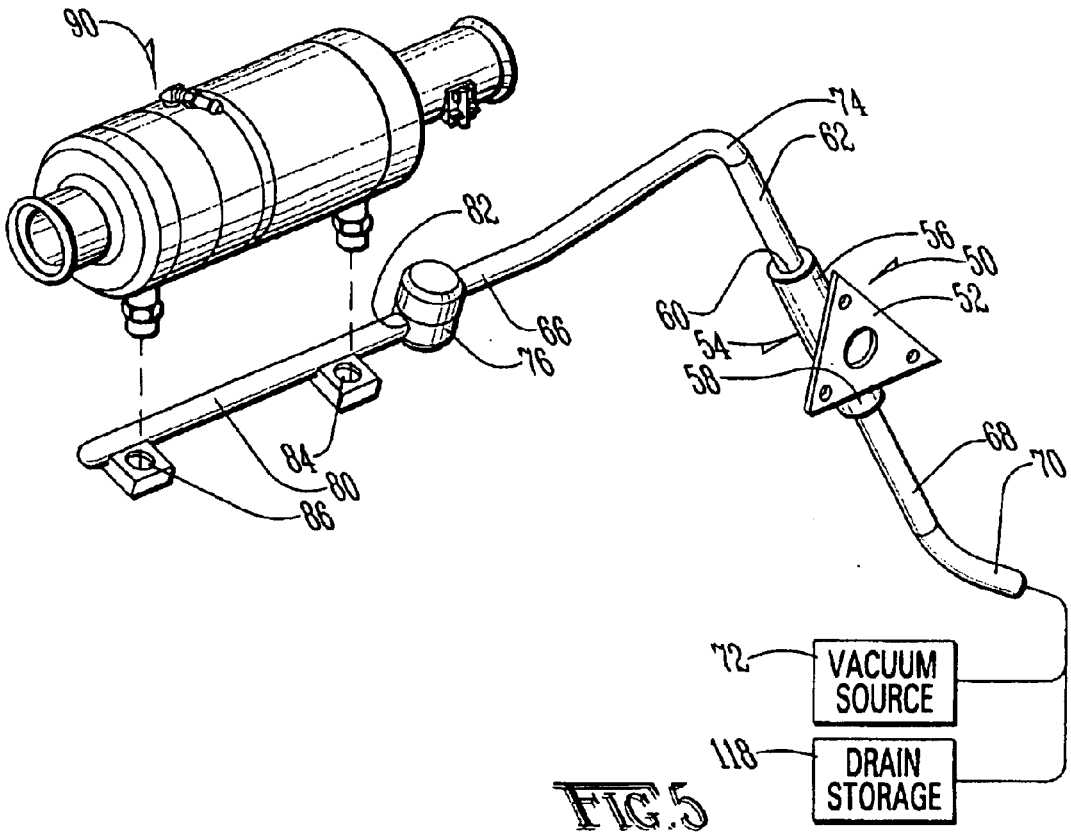
FIG. 5 shows a vacuum hose and a vacuum manifold in conjunction with a hose cleaning housing unit included in the present invention.
Figure 6:
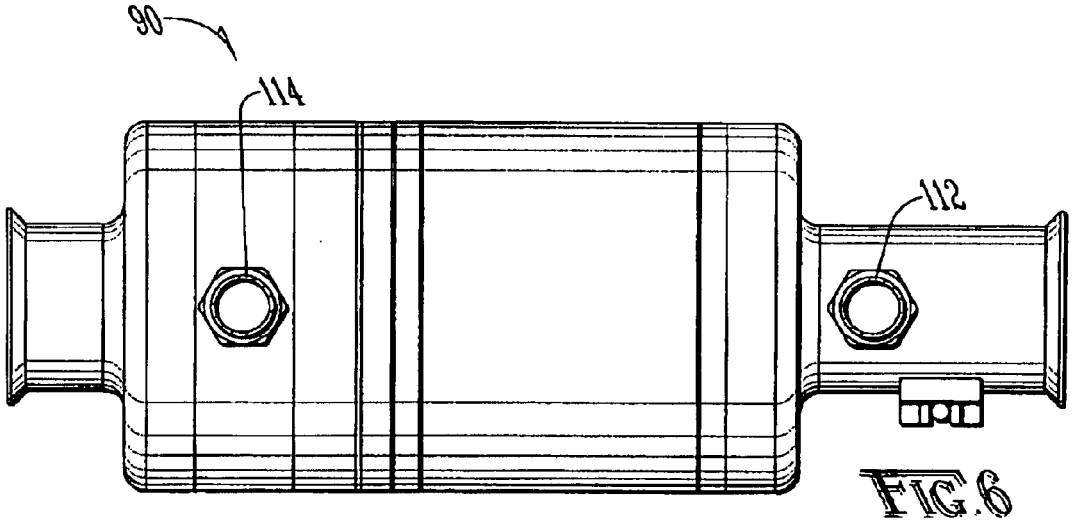
FIG. 6 shows a hose cleaning housing unit included in the present invention.
Figure 4:
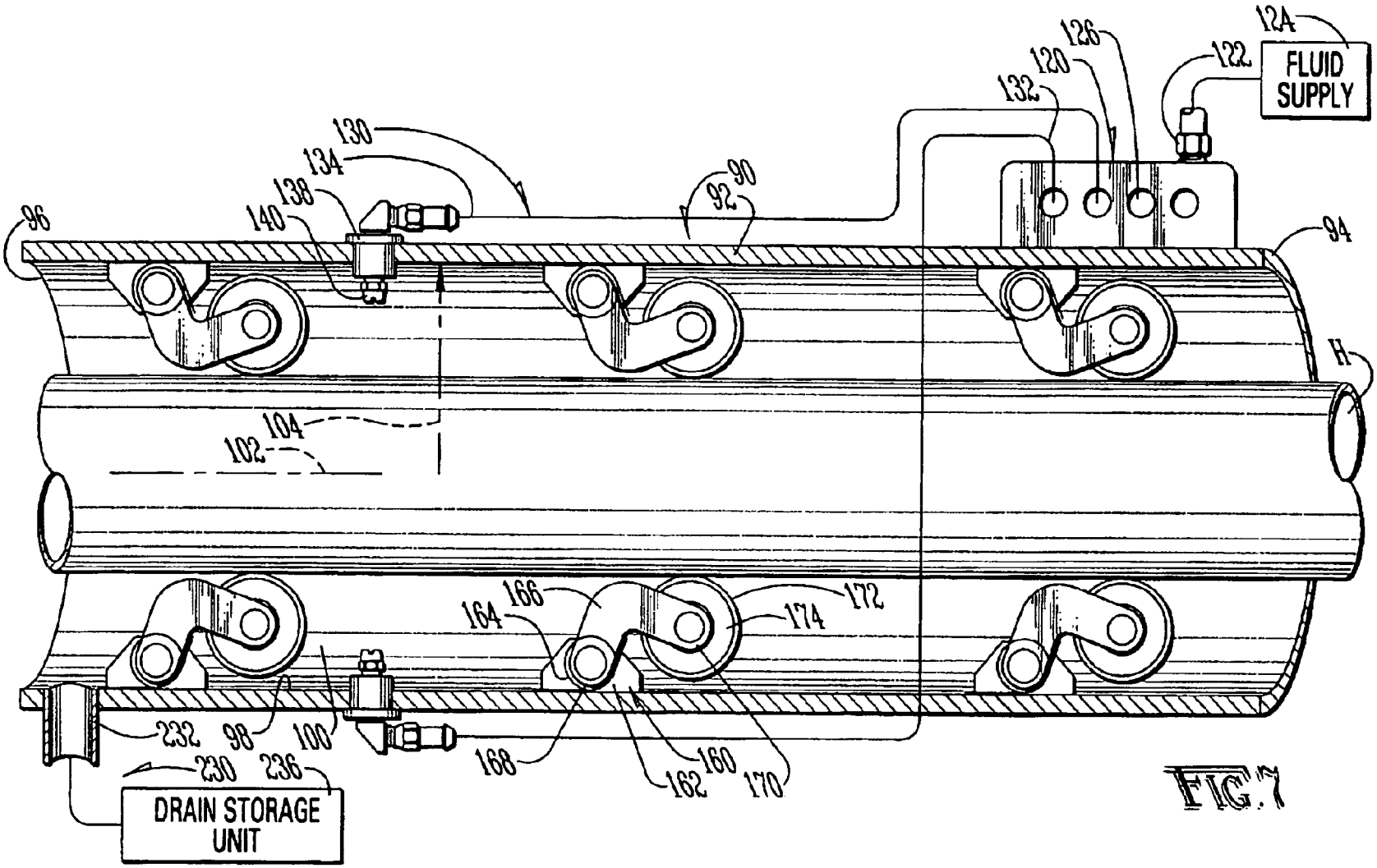
Figure 8:
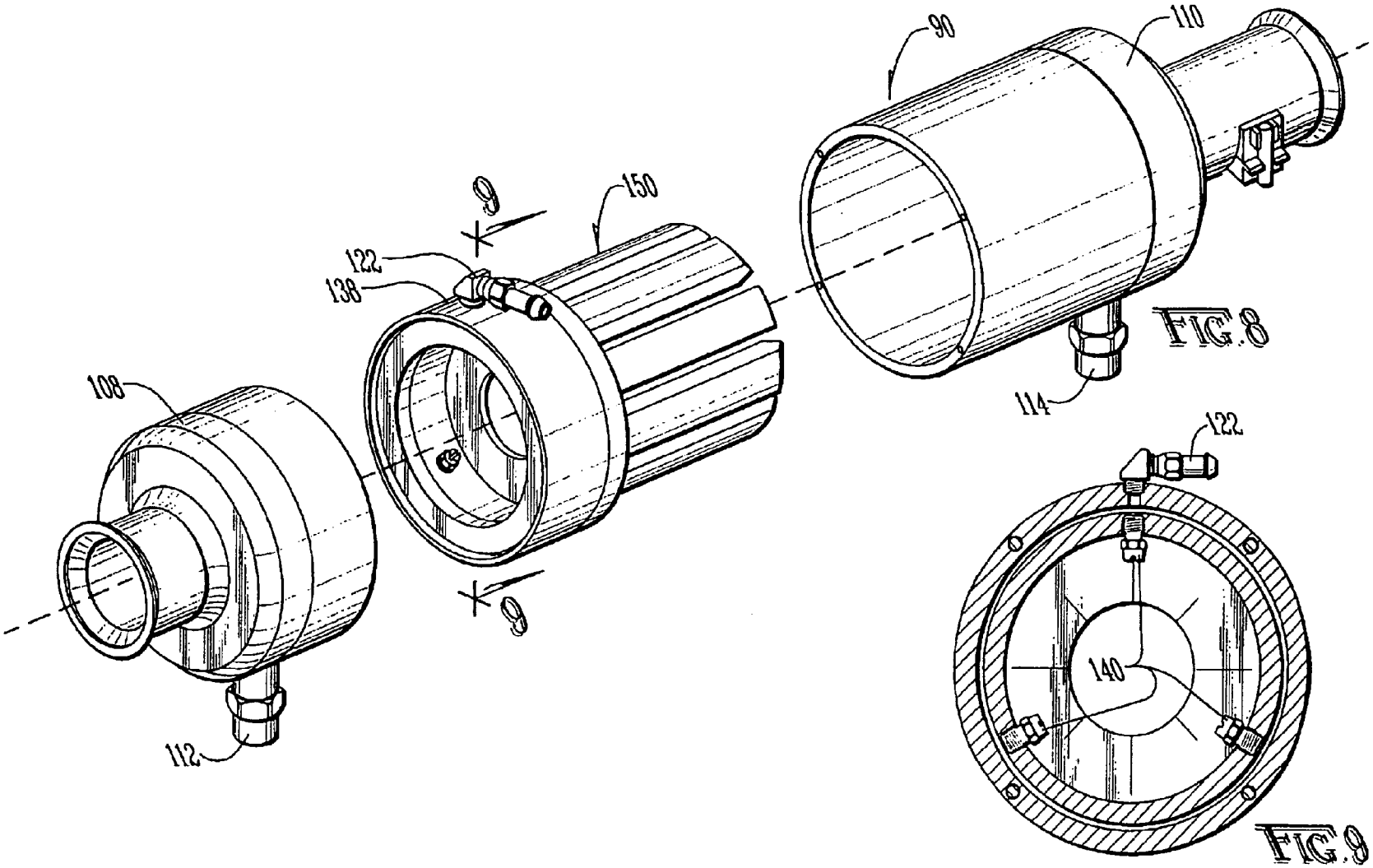
FIG. 8 is an exploded perspective view of the hose cleaning housing unit of the present invention.
Figure 10:
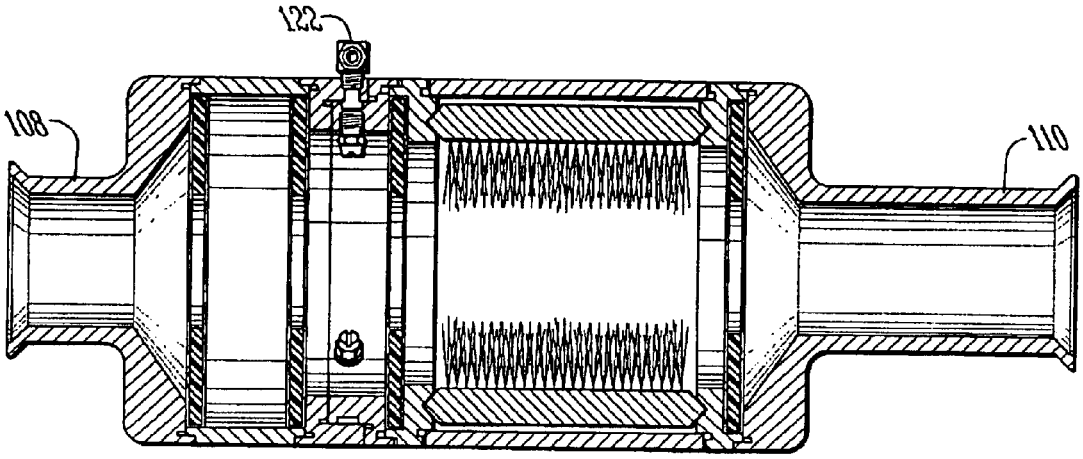
FIG. 10 shows a cutaway assembled view of one form of the hose cleaning housing unit.
Figure 11:
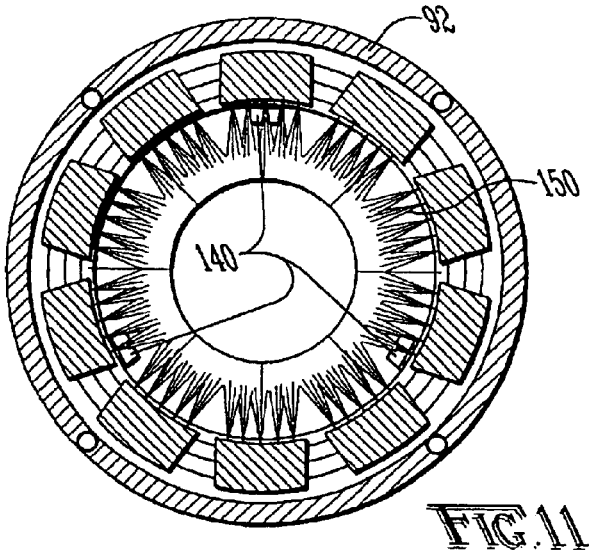
FIG. 11 shows a cross-sectional view of one form of the hose cleaning housing unit of the present invention.

The hose cleaning unit of the present invention further includes a hose cleaning assembly 50 on reel unit 20. Hose cleaning assembly 50 is shown in FIGS. 2, 4 and 5 and includes a swivel bracket plate 52 mounted on one of the upright standards of base 22 of reel unit 20 and includes a tubular sleeve 54 having first and second ends 56 and 58, a bore 60 extending between first and second ends 56 and 58 of tubular sleeve 54. Tubular sleeve 54 has an interior dimension defined by bore 60, the purpose of which will be understood from the teaching of the present disclosure. A vacuum supply tube 62 extends through bore 60 in tubular sleeve 54 and has an outer dimension that is smaller than the interior dimension of tubular sleeve 54 so the vacuum supply tube 62 is rotatable in tubular sleeve 54 from a first stored configuration extending over hose storage reel 40 as shown in FIG. 2 to a second deployed configuration shown in FIG. 4 extending away from hose storage reel 40. Vacuum supply tube 62 includes a first end 66 and a second end 68. A vacuum hose swivel cuff 70 is on second end 68 of the vacuum supply tube 62 and is fluidically connected to a vacuum source 72. An elbow 74 is located in vacuum supply tube 62 between first and second ends 66 and 68, and a swivel connection 76 is located on first end 66 of vacuum supply tube 62. A vacuum manifold 80 has an inlet end 82 fluidically connected to first end 66 of vacuum supply tube 62 and is physically connected to swivel connection 76 on first end 66 of vacuum supply tube 62. Vacuum manifold 80 includes first and second outlet ports 84 and 86 fluidically connected to inlet end 82 of vacuum manifold 80 to be fluidically connected to the vacuum source 72.

Unit 10 further includes a hose cleaning housing unit 90 mounted on vacuum manifold 80. Hose cleaning housing unit 90 is shown in the remaining figures and includes a hollow cylindrical housing 92 which has a first end 94 and a second end 96, an inside surface 98 defining an inside volume 100 in hollow cylindrical housing 92, a longitudinal axis 102 which extends between first and second ends 94 and 96 of hollow cylindrical housing 92, and a radial dimension that extends from the longitudinal axis to the inside surface of the hollow cylindrical housing in a plane that is perpendicular to a plane containing the longitudinal axis of the hollow cylindrical housing as indicated by unit vector 104 in FIG. 7. A first end cap 108 is positioned on first end 94 of cylindrical housing 92, and a second end cap 110 is positioned on second end 96 of the cylindrical housing of the hose cleaning housing unit. A first vacuum connection port 112, on first end cap 108 of the hollow cylindrical housing 92 of the hose cleaning housing unit, is fluidically connected to first outlet port 84 of vacuum manifold 80, and a second vacuum connection port 114, on second end cap 110 of hollow cylindrical housing 92 of the hose cleaning housing unit, is fluidically connected to second outlet port 86 of vacuum manifold 80. Vacuum source 72 applies a vacuum pressure to inside volume 100 of the hollow cylindrical housing 92 via vacuum supply tube 62. A debris storage unit 118 is fluidically connected to vacuum supply tube 62 and to inside volume 100 of the hollow cylindrical housing 92 so debris inside the housing can be withdrawn into storage unit 118.

A fluid manifold 120 is mounted on hollow cylindrical housing 92 near first end 94 of the hollow cylindrical housing 92 and includes a fluid inlet port 122 fluidically connected to a source 124 of hose cleaning fluid. A plurality of fluid outlet ports, such as outlet port 126, are fluidically connected to inlet port 122 of the fluid manifold .120 to receive fluid therefrom. A plurality of fluid conduits, such as fluid conduit 130, are connected to fluid manifold 120. Each of the fluid conduits 130 has a first end 132 fluidically connected to an associated fluid outlet port 126 of the fluid manifold 120 and a second end 134 spaced from first end 123 of the fluid conduit 130. A plurality of connection mounts, such as connection mount 138, connect the second ends 134 of the fluid conduits 130 to the hollow cylindrical housing 92 of the hose cleaning housing unit. A plurality of fluid spray jets, such as fluid spray jet 140, are mounted on inside surface 98 of the hollow cylindrical housing 92 of the hose cleaning housing unit and are each fluidically connected to the second end 134 of fluid conduit 130 associated with the fluid spray jet 140. The fluid spray jets 140 are spaced apart from each other along the radial dimension of the hollow cylindrical housing 92. In one form of the device, there is a single ring of spray jets 140, and in another form of the device there are several rings of spray jets with the rings of spray jets 140 being spaced apart from each other along longitudinal axis 102.

The device further includes a plurality of hose cleaning brushes, such as hose cleaning brush 150, best shown in FIGS. 10–13, mounted on inside surface 98 of the hollow cylindrical housing 92 of the hose cleaning unit. The hose cleaning brushes 150 are spaced apart from each other about the radial dimension of the hollow cylindrical housing 92, with each hose cleaning brush 150 of the plurality of hose cleaning brushes 150 extending along longitudinal axis 102 of the hollow cylindrical housing 92. In one form of the device, there is a single ring of hose cleaning brushes 150. However, other forms of the device include several rings of hose cleaning brushes 150 with the rings being spaced apart from each other along the longitudinal axis 102. The hose cleaning brushes 150 include bristles and are of the type commonly used to clean hoses.

The device further includes a plurality of hose support units, such as hose support unit 160, inside hollow cylindrical housing 92 of the hose cleaning housing unit. Hose support units 160 are spaced apart from each other along the longitudinal axis of the hollow cylindrical housing 92. Each hose support unit 160 includes a base 162 mounted on the hollow cylindrical housing 92 inside the hollow cylindrical housing 92, a shock absorber spring 164 in each base 160 between the hollow cylindrical housing 92 and the base 162 so the base 162 can move toward and away from inside surface 98 of the hollow cylindrical housing 92, a bracket arm 166 having a proximal end 168 connected to base 162 and extending in the radial direction of the hollow cylindrical housing 92 and having a distal end 170 spaced from the inside surface of the hollow cylindrical housing 92. Each hose support unit 160 further includes a bearing cage 172 mounted on distal end 170 of each bracket arm 166. Bearings 174 connect bearing cage 172 to distal end 170 of bracket arm 166. Bearing cage 172 is positioned to engage hose 14 located in the hollow cylindrical housing 92, with the bearing cage 172 being movable against shock absorber spring 164 between a first position and a second position with the first and second positions of the bearing cage 172 being spaced apart from each other along the radial direction of the hollow cylindrical housing 92 so hoses of various outer dimensional sizes can be accommodated by the hose supporting units 160.

Figure 12:
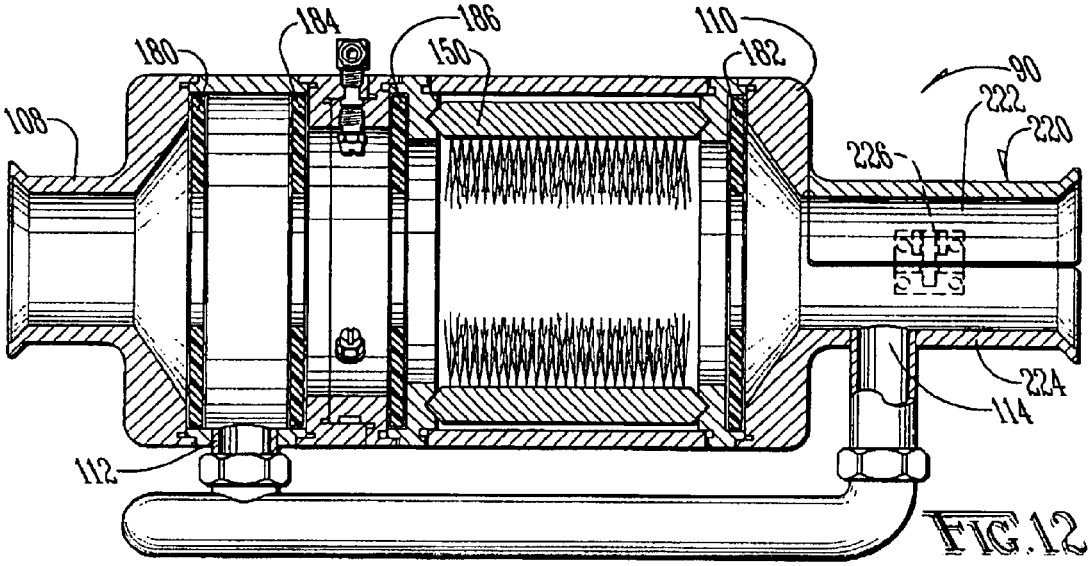
FIG. 12 shows a cut-away schematic view of one form of hose cleaning housing unit of the present invention.
Figure 14:
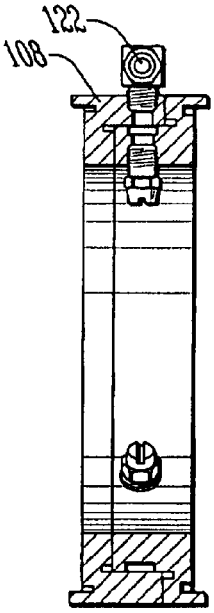
FIG. 14 shows a side elevational view of one end of the hose cleaning housing unit of the present invention.
Figure 13:
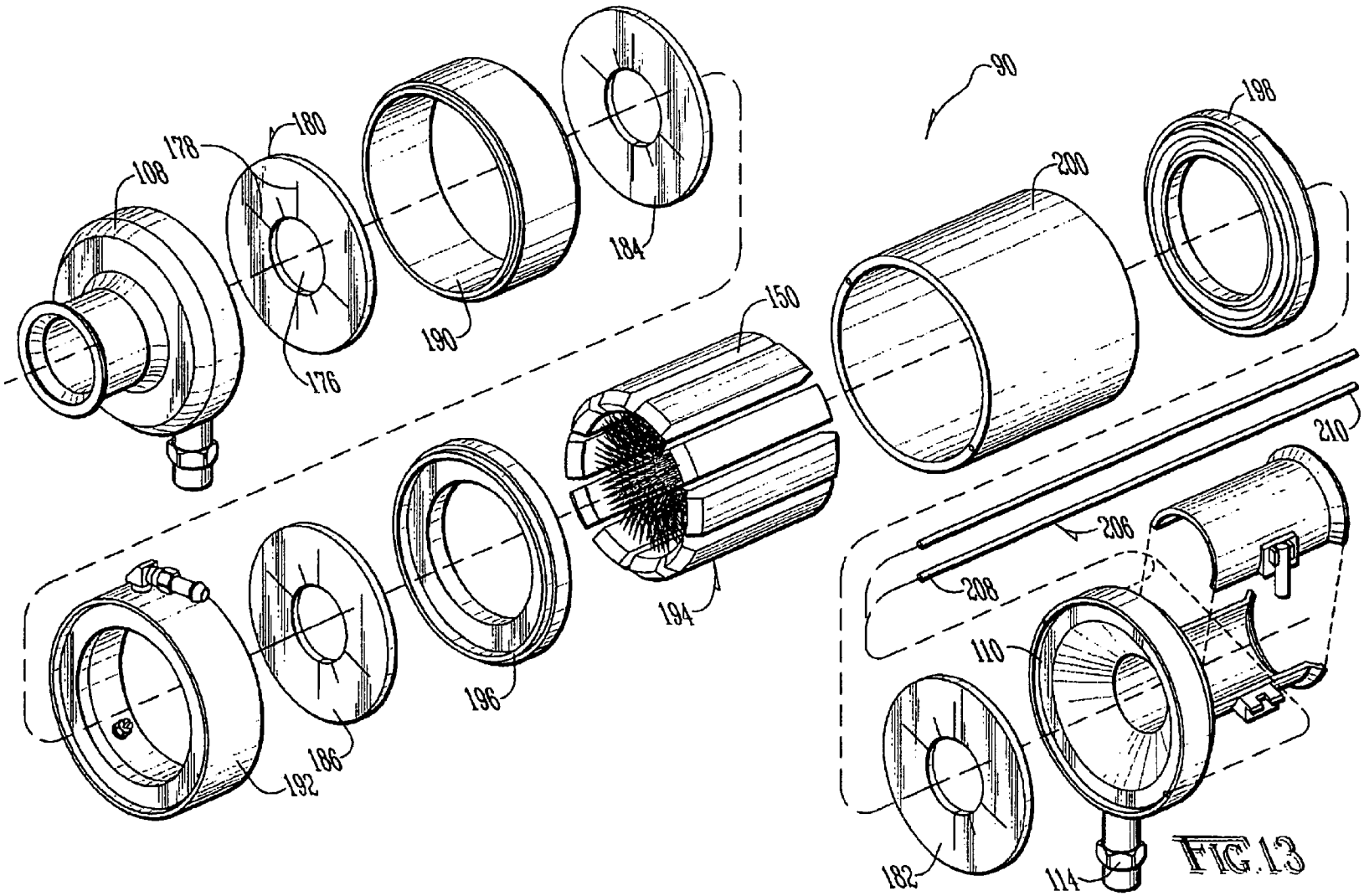
FIG. 13 shows an exploded perspective view of a hose cleaning housing unit to show the various elements included in that housing unit.

The device further includes a plurality of splash plates best shown in FIGS. 12 and 13, mounted on inside surface 98 of the hollow cylindrical housing 92 and extending along the radial direction of the hollow cylindrical housing 92. Each splash plate includes a bore, such as bore 176 defined therethrough and a plurality of slits, such as slits 178, defined from bore 176 defined through the splash plate. The bore in each splash plate is circular and the slits extend radially away from the circular bore 176 for a purpose that will be understood from the teaching of the present disclosure. The splash plates contact hose 14 adjacent to bore 176 defined through the splash plate when hose 14 is located in the hollow cylindrical bore, with the slits 178 opening or closing according to the outer dimensional size of the hose being accommodated. Thus, a variety of hose sizes can be accommodated by the device of the present invention. The plurality of splash plates include a first splash plate 180 located adjacent to the first end cap 108 of the hollow cylindrical housing 92, a second splash plate 182 located adjacent to second end cap 110 of the hollow cylindrical housing 92, a third splash plate 184 located adjacent to first splash plate 180 with first splash plate 180 being located between third splash plate 184 and first end cap 108, and a fourth splash plate 186 located adjacent to third splash plate 184 with third splash plate 184 being located between the fourth splash plate 186 and the first splash plate 180. The splash plates prevent fluid from inside the hollow cylindrical housing 92 from splashing out of the housing and also serve to wipe the hose as it passes through the housing.

As shown in FIG. 13, the device further includes a vacuum housing 190 on the inside surface of the hollow cylindrical housing 92 and extending along the longitudinal axis of the hollow cylindrical housing 92 between first and third splash plates 180 and 184 and fluidically connected to first vacuum connection port 112 of the hollow cylindrical housing 92. As shown in FIG. 13, the device further includes a jet manifold 192 located inside the hollow cylindrical housing 92 and fluidically connected to the second end of each fluid conduit 130 of the hose cleaning housing unit and to the fluid spray jets 140 of the hose cleaning housing unit and being located between the third and fourth splash plates 184 and 186. A brush receiver housing 194 is located inside the hollow cylindrical housing 92 between the second and fourth splash plates 182 and 186 and extends along the longitudinal axis of the hollow cylindrical housing 92. Brush receiver housing 194 includes a first ring element 196 located adjacent to fourth splash plate 186, a second ring element 198 located adjacent to second splash plate 182, and a central ring element 200 located between first and second ring elements 196 and 198 of the brush receiver housing 194 and which supports brush unit 150 thereon. The bases 162 of the hose support units 160 can be mounted on central ring element 200 of brush receiver housing 194.

The device further includes assembly rods, such as assembly rod 206, extending along the longitudinal axis of the hollow cylindrical housing 92 and having one end 208 connected to first splash plate 180 and another end 210 connected to second splash plate 182. If desired, the ends of the assembly rods 206 can be attached to other elements of the device, including the end plates.

The device further includes a hinged vacuum lid unit 220 shown in FIG. 12 mounted on second end cap 110 of the hollow cylindrical housing 92 and includes a top lid 222 and a bottom lid 224, and a hinge 226 connecting the top lid 222 of vacuum lid unit 220 to the bottom lid 224 of the vacuum lid unit 220 with the top lid 222 being movable with respect to the bottom lid 224 between an open configuration spaced from the bottom lid to a closed configuration in contact with the bottom lid 224.

The device further includes a fluid drain unit 230 shown in FIG. 7, which includes a drain element 232 fluidically connected to hollow cylindrical housing 92 near second end 96 of the hollow cylindrical housing 92. Drain element 232 of fluid drain unit 230 is fluidically connected to inside volume 100 of the hollow cylindrical housing 92 and also to a drain storage unit 236 which is fluidically connected to the drain element 232 of the fluid drain unit 230. Waste water can be directed to and through the vacuum line if desired.

It is noted that the ends are identified as "first" and "second" merely for convenience of description, and no limitation is intended.

It is understood that while certain forms of the present invention have been illustrated and described herein, it is not to be limited to the specific forms or arrangements of parts described and shown.

We claim:

1. A device for cleaning hoses comprising:

a) a reel unit which is sized to be accommodated on a vehicle and which includes
  1) a base which is rectangular and which has
    (A) a fore end,
    (B) a rear end, and
    (C) first and second sides,
  2) first and second upright standards which are fixed to the first and second sides of the base respectively and which extend upward from a plane containing the base of said reel unit, each of the upright standards
    (A) being triangular with a base portion formed by the side of the base associated therewith,
    (B) having an apex spaced apart from a plane containing the base of said reel unit, and
    (C) the apexes of the upright standards being spaced apart from each other, and
  3) a hose storage reel mounted on the apexes of the upright standards to rotate in a plane spaced from the plane containing the base of said reel unit;

b) a hose cleaning assembly on said reel unit and which includes
  1) a swivel bracket plate mounted on one of the upright standards of the base of said reel unit and which includes a tubular sleeve having
    (A) first and second ends,
    (B) a bore extending between the first and second ends of the tubular sleeve and having an interior dimension,
    (C) a vacuum supply tube extending through the bore in the tubular sleeve and having an outer dimension that is smaller than the interior dimension of the tubular sleeve so the vacuum supply tube is rotatable in the tubular sleeve from a first stored configuration extending over the hose storage reel to a second deployed configuration extending away from the hose storage reel, the vacuum supply tube including a first end and a second end,
    (D) a vacuum hose swivel cuff on the second end of the vacuum supply tube and which is fluidically connected to a vacuum source,
    (E) an elbow in the vacuum supply tube between the first and second ends of the vacuum supply tube,
    (F) a swivel connection on the first end of the vacuum supply tube, and
    (G) a vacuum manifold having an inlet end fluidically connected to the first end of the vacuum supply tube and connected to the swivel connection on the first end of the vacuum supply tube, the vacuum manifold including first and second outlet ports fluidically connected to the inlet end of the vacuum manifold,
  3) a hose cleaning housing unit mounted on the vacuum manifold and which includes
    (A) a hollow cylindrical housing which has
      (i) first and second ends,
      (ii) an inside surface defining an inside volume in said hollow cylindrical housing,
      (iii) a longitudinal axis which extends between the first and second ends of the hollow cylindrical housing, and a radial dimension that extends from the longitudinal axis to the inside surface of the hollow cylindrical housing in a plane that is perpendicular to a plane containing the longitudinal axis of the hollow cylindrical housing,
      (iv) a first end cap on the first end of the cylindrical housing of the hose cleaning housing unit,
      (v) a second end cap on the second end of the cylindrical housing of the hose cleaning housing unit,
      (vi) a first vacuum connection port on the first end of the hollow cylindrical housing of the hose cleaning housing unit fluidically connected to the first outlet port of the vacuum manifold,
      (vii) a second vacuum connection port on the second end cap of the hollow cylindrical housing of the hose cleaning housing unit fluidically connected to the second outlet port of the vacuum manifold,
      (viii) the vacuum source applying a vacuum pressure to the inside of the hollow cylindrical housing via the vacuum supply tube, and
      (ix) a debris storage element fluidically connected to the vacuum supply tube and to the inside of the hollow cylindrical housing,
    (B) a fluid manifold mounted on the hollow cylindrical housing near the first end of the hollow cylindrical housing and including a fluid inlet port fluidically connected to a source of hose cleaning fluid and a plurality of fluid outlet ports fluidically connected to the inlet port of the fluid manifold,
    (C) a plurality of fluid conduits, each fluid conduit having a first end fluidically connected to an associated fluid outlet port of the fluid outlet ports of the fluid manifold and a second end spaced from the first end of the fluid conduit,
    (D) a plurality of connection mounts with each connection mount connecting the second end of an associated fluid conduit to the hollow cylindrical housing of the hose cleaning housing unit,
    (E) a plurality of fluid spray jets, each fluid spray jet mounted on the inside surface of the hollow cylindrical housing of the hose cleaning housing unit and fluidically connected to the second end of a fluid conduit associated with the fluid spray jet,
    (F) the fluid spray jets being spaced apart from each other along the radial dimension of the hollow cylindrical housing,
    (G) a plurality of hose cleaning brushes mounted on the inside surface of the hollow cylindrical housing of the hose cleaning unit, the hose cleaning brushes being spaced apart from each other about the radial dimension of the hollow cylindrical housing, each hose cleaning brush of the plurality of hose cleaning brushes extending along the longitudinal axis of the hollow cylindrical housing, (H) a plurality of hose support units inside the hollow cylindrical housing of the hose cleaning housing unit, (i) the hose support units being spaced apart from each other along the longitudinal axis of the hollow cylindrical housing, and (ii) each hose support unit including a support base mounted on the hollow cylindrical housing inside the hollow cylindrical housing, a shock absorber spring in each support base between the hollow cylindrical housing and the support base so the support base can move toward and away from the inside surface of the hollow cylindrical housing, a bracket arm having a proximal end connected to the support base and extending in the radial direction of the hollow cylindrical housing and having a distal end spaced from the inside surface of the hollow cylindrical housing, each hose support unit further including a bearing cage mounted on the distal end of each bracket arm, bearings connecting the bearing cage to the distal end of the bracket arm, the bearing cage being positioned to engage a hose located in the hollow cylindrical housing and being movable against the shock absorber spring between a first position and a second position with the first and second positions of the bearing cage being spaced apart from each other along the radial direction of the hollow cylindrical housing so hoses of various outer dimensional sizes can be accommodated by the hose supporting units, (I) a plurality of splash plates mounted on the inside surface of the hollow cylindrical housing and extending along the radial direction of the hollow cylindrical housing, each splash plate including a bore defined therethrough and a plurality of slits defined from the bore defined through the splash plate, the bore in each splash plate being circular and the slits extending radially away from the bore, the splash plate contacting the hose adjacent to the bore defined through the splash plate when the hose is located in the hollow cylindrical bore, the plurality of splash plates including a first splash plate located adjacent to the first end cap of the hollow cylindrical housing, a second splash plate located adjacent to the second end cap of the hollow cylindrical housing, a third splash plate located adjacent to the first splash plate with the first splash plate being located between the third splash plate and the first end cap, and a fourth splash plate located adjacent to the third splash plate with the third splash plate being located between the fourth splash plate and the first splash plate, (J) a vacuum housing on the inside surface of the hollow cylindrical housing and extending along the longitudinal axis of the hollow cylindrical housing between the first and third splash plates and fluidically connected to the first vacuum connection port of the hollow cylindrical housing, (K) a jet manifold located inside the hollow cylindrical housing and fluidically connected to the second end of each fluid conduit of the hose cleaning housing unit and to the fluid spray jets of the hose cleaning housing unit and being located between the third and fourth splash plates, (L) a brush receiver housing located inside the hollow cylindrical housing between the second and fourth splash plates and (i) extending along the longitudinal axis of the hollow cylindrical housing, (ii) including a first ring element located adjacent to the fourth splash plate, a second ring element located adjacent to the second splash plate, (iii) a central ring located between the first and second ring elements of the brush receiver housing, and (iv) the support bases of the hose support units each being mounted on the central ring element of the brush receiver housing, (M) an assembly rod extending along the longitudinal axis of the hollow cylindrical housing and having one end connected to the first splash plate and another end connected to the second splash plate, and (N) a hinged vacuum lid unit mounted on the second end cap of the hollow cylindrical housing and having a top lid and a bottom lid and a hinge connecting the top lid of the vacuum lid unit to the bottom lid of the vacuum lid unit with the top lid being movable with respect to the bottom lid between an open configuration spaced from the bottom lid to a closed configuration in contact with the bottom lid; and c) a fluid drain unit which includes 1) a drain element fluidically connected to the hollow cylindrical housing near the second end of the hollow cylindrical housing, 2) the drain element of the fluid drain unit being fluidically connected to the inside of the hollow cylindrical housing, and 3) a drain storage unit which is fluidically connected to the drain element of the fluid drain unit.

2. The device for cleaning hoses as described in claim 1 further including a plurality of additional hose cleaning brushes which are spaced apart from each other along the longitudinal axis of the hollow cylindrical housing.

3. The device for cleaning hoses as described in claim 1 further including a plurality of additional fluid spray jets which are spaced apart from each other along the longitudinal axis of the hollow cylindrical housing.

4. A unit for cleaning a hose comprising:

a) a hose reel;

b) a vacuum hose mounted on said hose reel to be movable between a first position and a second position, and c) a hose cleaning assembly mounted on said hose reel and through which said vacuum hose passes and which includes:

(1) a hollow housing mounted on the vacuum hose and fluidically connected to the vacuum hose, (2) a hose cleaning jet spray unit in the hollow housing, (3) a hose supporting unit in the hollow housing and which includes a spring shock absorber and is movable between a first position and a second position spaced from the first position inwardly of the hollow housing, (4) a source of hose cleaning fluid fluidically connected to the hose cleaning jet spray unit, (5) a hose cleaning brush unit in the hollow housing, and (6) a vacuum source fluidically connected to the vacuum hose.

5. The unit as described in claim 4 wherein the hose cleaning jet spray unit includes a plurality of hose cleaning jet spray units.

6. The unit as described in claim 4 wherein the hose supporting unit includes a plurality of hose supporting units.

7. The unit as described in claim 4 wherein the hose cleaning brush unit includes a plurality of hose cleaning brush units.

* * * * *